US010065709B2

(12) United States Patent
Goves

(10) Patent No.: US 10,065,709 B2
(45) Date of Patent: Sep. 4, 2018

(54) CRADLE ASSEMBLY FOR BOATS

(71) Applicant: BAE SYSTEMS plc, London (GB)

(72) Inventor: Dean Michael Goves, Portsmouth (GB)

(73) Assignee: BAE SYSTEM PLC, London (GB)

( * ) Notice: Subject to any disclaimer, the term of this patent is extended or adjusted under 35 U.S.C. 154(b) by 0 days.

(21) Appl. No.: 14/895,831

(22) PCT Filed: May 30, 2014

(86) PCT No.: PCT/GB2014/051651

§ 371 (c)(1),
(2) Date: Dec. 3, 2015

(87) PCT Pub. No.: WO2014/195682

PCT Pub. Date: Dec. 11, 2014

(65) Prior Publication Data

US 2016/0121972 A1 May 5, 2016

(30) Foreign Application Priority Data

Jun. 5, 2013 (EP) ..... 13275133
Jun. 5, 2013 (GB) ..... 1309992.4

(51) Int. Cl.
*B63B 21/00* (2006.01)
*B63B 59/02* (2006.01)
(Continued)

(52) U.S. Cl.
CPC ..... *B63B 21/00* (2013.01); *B63B 23/30* (2013.01); *B63B 27/36* (2013.01); *B63B 59/02* (2013.01); *B63B 2059/025* (2013.01)

(58) Field of Classification Search
CPC .. B63C 1/02; B63C 3/06; B63B 23/40; B63B 21/00; B63B 59/00; B63B 59/02;
(Continued)

(56) References Cited

U.S. PATENT DOCUMENTS 4,679,517 A * 7/1987 Kramer ..... B63B 59/02 114/259
5,095,840 A * 3/1992 Kramer ..... B29C 33/0033 114/219
(Continued)

FOREIGN PATENT DOCUMENTS

GB 2004818 A 4/1979
GB 2012238 A 7/1979
(Continued)

OTHER PUBLICATIONS

International Search Report and Written Opinion received for Patent Application No. PCT/GB2014/051651, dated Jul. 14, 2014. 10 pages.
(Continued)

*Primary Examiner* — Lars A Olson
(74) *Attorney, Agent, or Firm* — Finch & Maloney PLLC

(57) ABSTRACT

According to a first aspect of the invention, there is provided a cradle assembly for cradling a boat, the cradle assembly comprising: a support, comprising one or more support fenders; one or more enclosure fenders extending along opposite lengths of the support; an arrestor located at one end of the support; an open-ended enclosure for a boat being formed between the support, the one or more enclosure fenders and the arrestor, the one or more support fenders facing into the enclosure, and the open end of the open-ended enclosure being opposite the arrestor.

18 Claims, 8 Drawing Sheets

(51) Int. Cl.
*B63B 23/30* (2006.01)
*B63B 27/36* (2006.01)

(58) Field of Classification Search
CPC ... B63B 2059/025; B63B 21/58; B63B 35/44; B63B 35/40; B63B 27/00; B63B 27/14; B63B 35/42
USPC ..... 114/219, 258, 248, 259
See application file for complete search history.

(56) References Cited

U.S. PATENT DOCUMENTS

| | | | | |
|---|---|---|---|---|
| 5,791,278 | A * | 8/1998 | Orndorff, Jr. ..... | B29C 33/0033 114/219 |
| 6,682,804 | B2 * | 1/2004 | Orndorff, Jr. ..... | B29C 33/0033 114/219 |
| 7,637,224 | B1 | 12/2009 | Portmann et al. | |
| 7,827,925 | B2 * | 11/2010 | Hirayama ..... | B63B 35/40 114/259 |
| 2002/0038623 | A1 * | 4/2002 | Irish ..... | B63B 35/42 114/259 |
| 2006/0182554 | A1 | 8/2006 | Stolzer | |
| 2006/0254491 | A1 | 11/2006 | Seiple | |

FOREIGN PATENT DOCUMENTS

| | | | |
|---|---|---|---|
| JP | 58102339 | U | 7/1983 |
| JP | 3044095 | U | 12/1997 |
| WO | 9739940 | A1 | 10/1997 |
| WO | 2004063002 | A1 | 7/2004 |
| WO | 2005030571 | A2 | 4/2005 |
| WO | 2010147518 | A1 | 12/2010 |
| WO | 2012069853 | A2 | 5/2012 |
| WO | 2014195682 | A1 | 12/2014 |

OTHER PUBLICATIONS

GB Intellectual Property Office Search Report under Section 17(5) received for GB Patent Application No. 1309992.4 dated Sep. 26, 2013. 3 pages.

Extended European Search Report received for EP Patent Application No. 13275133.0 dated Oct. 25, 2013. 7 pages.

International Preliminary Report on Patentability received for Patent Application No. PCT/GB2014/051651, dated Dec. 17, 2015 6 pages.

* cited by examiner

CRADLE ASSEMBLY FOR BOATS

The present invention relates to a cradle assembly, and in particular a cradle assembly for cradling a boat. The present invention also relates to a boat having such a cradle assembly, for use in cradling a smaller boat within the cradle assembly of the, for example larger, boat.

Cradle assemblies are used to retrieve or capture a boat, to store a boat, and/or to release or launch a boat. Such a cradle assembly may attach to or form part of a land-based structure, or may be part of or form a floating structure. For instance, a cradle assembly may be used in a relatively large boat in order to cradle a relatively smaller boat within that larger boat.

Typically, a cradle assembly takes the form of a rigid frame, usually comprising interconnected metal struts or the like. The frame is usually shaped, or more generally configured, to cooperate with the shape of the boat to be received by the cradle assembly. For instance, the frame may define a shape that matches, or substantially matches, a shape of a hull of a boat to be received and cradled, such that the boat may be cradled in an effective manner. However, and typically, little regard is given to protection of the cradle, or perhaps more importantly the boat, in the design and construction of existing cradle assemblies.

If a boat is to be received and captured by a cradle assembly, it is likely that the boat will need to be, in some way, propelled into/onto the cradle assembly. This will involve the boat coming into contact with the cradle assembly. Such contact can result in damage to the frame of the cradle assembly, or the boat, and in particular the hull of the boat. This is particularly true if the boat is to be captured at speed. For instance, it is not always convenient or possible to capture the boat when the boat is stationary or almost stationary, or moving at a very low speed. In some instances, the boat will be moving at a relatively high speed, perhaps not usually associated with conventional cradling assemblies.

It is an aim of exemplary embodiments of the present invention to provide an apparatus which obviates or mitigates one or more disadvantages of the prior art, whether identified herein or elsewhere, or to provide an alternative to existing apparatus.

According to the present invention there is provided an apparatus as set forth in the appended claims. Other features of the invention will be apparent from the dependent claims, and the description which follows.

According to a first aspect of the invention, there is provided a cradle assembly for cradling a boat, the cradle assembly comprising: a support, comprising one or more support fenders; one or more enclosure fenders extending along opposite lengths of the support; an arrestor located at one end of the support; an open-ended enclosure for a boat being formed between the support, the one or more enclosure fenders and the arrestor, the one or more support fenders facing into the enclosure, and the open end of the open-ended enclosure being opposite the arrestor.

At least a part of one or more of the following may be deformable or resiliently deformable: the one or more support fenders; the one or more enclosure fenders; and/or the arrestor.

The support fenders and/or the enclosure fenders may be controllably inflatable and/or controllably deflatable. That is, the fenders may be inflated or deflated to stable states between fully inflated and fully deflated.

The support fenders and/or the enclosure fenders may comprise or be provided with cladding.

The support fenders and/or the enclosure fenders, and/or any cladding thereof, may comprise one or more of, or a combination of: polychloroprene and/or chlorosulfonated polyethylene. Alternatively, any synthetic or natural rubber may be used.

The support fenders, and/or the enclosure fenders, may comprise one or more of: a predominantly energy absorbing support fender; and/or a predominantly load bearing support fender.

The support fenders, and/or the enclosure fenders, may comprise a predominantly energy absorbing support fender and/or a predominantly load bearing support fender. The energy absorbing support fender may cover or overly the load bearing support fender.

The arrestor may comprise an adjuster for adjusting a resistance (e.g. to deformation by a boat) provided by the arrestor.

The arrestor may comprise a net and/or one or more kinetic energy recovery elements. The kinetic energy recovery elements may be used to fix the net to an object, and/or may form a part of the net.

The support may comprise first and second support sections, spaced apart from one another along a length of the support, and arranged to support for and aft sections of the boat.

A position and/or orientation of one or more parts of the support may be adjustable.

One or more of the enclosure fenders may be configured to remain in contact with the boat when the boat is located in the enclosure.

One or more fenders may be provided to form a guide to the open end of the enclosure. These fenders may be the same as the enclosure fenders, and might be described as enclosure fenders.

According to a second aspect of the invention, there is provided a boat comprising the cradle assembly of the first aspect of the invention. The boat is thus capable of cradling a smaller boat in the boat cradle assembly.

The cradle assembly may be located in a section of the boat, within which section a fluid level is controllable to: lower the smaller boat on to the support of the cradle assembly; and/or to raise the smaller boat from the support.

Features of any aspect/embodiment described herein may, where appropriate to the skilled person, be combined with and/or replace a feature of another aspect/embodiment, without departing from the scope of the invention as defined by the claims.

For a better understanding of the invention, and to show how example embodiments of the same may be carried into effect, reference will be made, by way of example only, to the accompanying diagrammatic Figures in which:

FIG. 1 schematically depicts an end-on view of a cradle assembly according to an example embodiment of the present invention;

FIG. 2 schematically depicts a plan view of the cradle assembly of FIG. 1;

FIG. 3 schematically depicts detail of the arrestor of FIG. 1 and FIG. 2;

FIGS. 4-6 schematically depict details of the enclosure fenders of FIG. 1 and FIG. 2;

FIG. 7 schematically depicts detail of the support fender of FIG. 1 and FIG. 2;

FIGS. 8-13 schematically depict principles associated with the use of the cradle assembly of FIG. 1 and FIG. 2; and FIG. 14 schematically depicts a boat comprising the cradle assembly of FIG. 1 and FIG. 2, in accordance with another example embodiment of the present invention.

One or more problems associated with prior art cradle assemblies and/or an alternative to such prior art cradle assemblies, is provided in an exemplary embodiment of the present invention. In general terms, an exemplary embodiment of the present invention provides a cradle assembly for cradling a boat. The cradle assembly comprises a support. The support comprises one or more support fenders for use in protecting the boat and/or support. One or more enclosure fenders are provided. The one or more enclosure fenders extend along opposite lengths of the support. In one instance, the enclosure fenders may extend along opposite lengths of an external periphery of the support, but in other embodiments the enclosure fenders may be attached to, or even extend through the support. The 'length' may be a direction parallel to a direction in which a length of the boat extends, when cradled. The enclosure fenders are provided to, at least in one example, enclose and at least partially surround the boat when cradled. One or more enclosure fenders may be in contact with the boat, when cradled. An arrestor is located at one end of the support. The arrestor is provided to arrest motion of the boat when it enters into or onto the cradle assembly, and also to at least partially enclose the boat together with the closure fenders. An open-ended enclosure for the boat is formed between the support, the one or more enclosure fenders and the arrestor. The one or more support fenders face into the enclosure. Thus, the boat is enclosed and protected by the fenders and the arrestor, and may be supported by the support. The open end of the open-ended enclosure is opposite the arrestor. The boat enters the enclosure through this open end.

The exemplary embodiment provides a protective enclosure for the boat. Primarily, the protection is such that any damage to the boat during capture with the cradle assembly, storing in the cradle assembly, or launch from the cradle assembly, is minimised or reduced in comparison with existing cradle assemblies which do not have such fenders and/or an arrestor. The protection may allow the boat to be captured at a higher speed in comparison with existing cradles. At the same time, the fenders and arrestors may provide protection for the cradle assembly itself. The protection may thus be important if the boat and/or cradle assembly are to be used on multiple occasions, and are not single-use in nature.

For the purposes of describing the invention and features thereof, a "boat" may be interpreted, at least in one instance, as anything that may float and propel itself. Thus, a boat may be a ship, a submersible, a hovercraft, and so on. 'Boat' may be interchanged with any of those terms, and the perhaps more functional term 'watercraft'.

Specific exemplary embodiments of the invention will now be described with reference to accompanying FIGS. 1 through 14, by way of example only. The Figures have not been drawn to any particular scale, and are provided as an explanatory aid for the understanding of the principles underlying the invention, only. The same features appearing in different Figures have been given the same reference numerals, for consistency and clarity.

FIGS. 1 and 2 schematically depict, respectively, end-on and plan views of a cradle assembly (2) in accordance with an exemplary embodiment. As shown in those Figures, the cradle assembly (2) of this exemplary embodiment provides two enclosures (4, 6) for cradling two different boats. However, it will be appreciated that the present invention is not so limited, and principles associated with the cradle assembly may be equally applied to a cradle assembly for cradling only a single boat, or for cradling more than two boats.

The cradle assembly (2) is shown relative to walls (8), which could, for example, be walls or floors of a dock, harbour or some other land-based structure, or walls of a boat or floating installation. The cradle assembly (2) comprises a support (10). The support (10) is used to hold and support a boat (not shown, but shown in later Figures). The support (10) may be provided with or comprise one or more support fenders (12) that face into the enclosure (4, 6), and which are used to protect a boat from the support (10), and to protect the support (10) from the boat.

A plurality of enclosure fenders (14) are shown as extending along opposite external or peripheral lengths of the support (10). The enclosure fenders (14) are provided to prevent a boat coming into contact with the wall (8), and/or a boat in an adjacent enclosure (4, 6). The enclosure fenders (14), or similar or identical fenders, may extend beyond the extent of the support (10) and beyond an opening (16) of the enclosures (4, 6) to form a guide (18) to each enclosure (4, 6). The guide (18) may be slightly flared or tapered outwardly, facilitating or improving the guiding functionality.

The assembly (2) also comprises an arrestor (20) located at an end of the support (10), opposite to the opening (16) of the enclosures (4, 6). The arrestor (20) is provided to arrest, that is stop, motion of a boat entering into the enclosures (4, 6), and/or to assist in retaining the boat in the respective enclosure (4, 6).

The Figures show that the support (10), and the fenders (12) thereof, the one or more enclosure fenders (14), and the arrestor (20) together form the enclosures (4, 6), and might thus be described as providing a protective cradle for the boat to be located in the enclosures (4, 6).

The support (10) may be formed from one or more solid sections or similar. However, it is likely that the support (10) will take the form of a frame or scaffold, which may offer required strength and rigidity, but with lower weight than a more solid block-like construction. The support (10) may comprise a first section (22) and a second section (24), spaced apart from one another along a length of the support (10). The first and second support sections (22, 24) are arranged to support fore and aft sections of the boat when located in the enclosure (4, 6). The first and second support sections (22, 24) may be raised relative to one or more other sections of the support (10) to provide the required support to the fore and aft sections of the boat. There may be little or no need to support a mid-section of the boat. However, in another embodiment, greater than two support sections may be useful and/or required.

The support fenders (12) are conveniently located on the first and second support sections (22, 24), since these are likely to be the only sections of the support (10) that have any to come into contact with the boat.

A position and/or orientation of one or more parts of the support (10) may be adjustable. The adjustment may be such that boats of different sizes or shapes or the like may be accommodated and supported by the cradle assembly (2). For instance, one or more parts of the support (10) may be raised or lowered, or moved longitudinally along the support—i.e. along a length of the support (10). For instance, one or more of the first and/or second support sections (22, 24) may be moved longitudinally along the support (10) to support boats of different lengths, or weights, or the like. Similarly, an angle of inclination of one or more faces of the support (10), for example of the support sections (22, 24), may be altered to take into account and accommodate different boats having different hull shapes.

Whether or not the support (10) is adjustable in nature, the support will generally be shaped to cooperate with the shape of the boat that is to be supported, to make that support more effective. For instance, one or more struts or the like of the support, or a shape of a holding section of the support, may be a reciprocal shape, or at least an approximated reciprocal shape, of the boat to be supported.

As shown in the Figures, the enclosure fenders (14) substantially surround the support, and thus surround a boat when located in the enclosure. Although not shown in the Figures, the enclosure fenders (14) may be biased or located such that when a boat is located in an enclosure (4, 6), the enclosure fenders (14) come into contact with the boat, and remain in contact. This may facilitate retaining of the boat in a certain position, and/or assist in guiding the boat when it enters or leaves the enclosure.

In the Figures, multiple fenders are shown, either as enclosure fenders (14), or support fenders (12). As will be discussed in more detail below, these fenders may be individual and independent in form. This may facilitate placement or maintenance. However, in other embodiments (not shown), the enclosure fenders, for example, may take the form of a single continuous fender that extends substantially around the support, or attaches to the support, or extends through the support. The same may be true of the support fenders (12).

In order to facilitate the guiding of the boat into or out of an enclosure (4, 6), and/or the retention of the boat within an enclosure (4, 6), and/or to facilitate the general protection of the boat when in an enclosure (4, 6), the one or more support fenders (12), the one or more enclosure fenders (14), and/or the arrestor (20) are likely, in practice, to be deformable or resiliently deformable. Such deformation may make it easier to accommodate the boat in the enclosure (4, 6), and/or add to the facilitate protection of the boat or cradle assembly (2). Preferably, the fenders and/or the arrestor will be resiliently deformable, in that after deformation has taken place, the shape of the fenders and/or arrestor returns, or substantially returns, to its initial shape for subsequent, repeated use. This allows for multiple use of the cradle assembly (2) without having to replace or in some way restore the configuration of one or more parts of the cradle assembly.

In general, the fenders (12, 16) may comprise one or both of an energy absorbing component and/or a load bearing component. The energy absorbing component may be provided to absorb impacts when, for example, the boat enters the enclosure, or moves around within the enclosure. The load bearing component may be used to support the energy absorbing component, and/or used to support the weight of the boat, if and when the boat is supported by the support (10). The energy absorbing component may be more deformable than the load bearing component.

General principles associated with the cradle assembly (2) have been described in relation to FIGS. 1 and 2. Exemplary detail of the construction of the cradle assembly (2), and also of use of the cradle assembly (2), will now be provided with reference to FIGS. 3 to 14.

FIG. 3 schematically depicts exemplary detail of an example embodiment of the arrestor (20). The arrestor (20) comprises a net (30). The net (30) may be formed from one or more interconnected elements or strands or similar. The elements or strands or similar may be synthetic in nature, for example formed from a polymer material or the like. The net may be elastic in nature, to facilitate deformation and its arresting function. Elements of the net (30) may be enveloped in foam, for example, expanded or solid foam. The foam may be housed in a tube. This overall arrangement may assist in protecting the net from damage, and/or may assist in spreading a load provided on the net (30).

The net (30) may be attached to a surrounding structure using one or more fixation points (32), and via one or more attachment elements (34). The attachment elements (34) might preferably take the form of kinetic energy recovery elements, sometimes referred to as kinetic elements or recovery elements. Alternatively and/or additionally, the net (30) may comprise such elements. The elements (34) may facilitate the provision of an elastic restoring force to the net, and a boat in contact with the net. This may thus provide a convenient way of decelerating and thus arresting a boat that comes into contact with the net (30).

The arrestor (20) may further comprise one or more adjusters (36) for adjusting a resistance provided by the arrestor (20). The adjuster or adjusters (36) may form part of, or be attached to, one or more of the fixation points (32). The adjuster (36) may take any suitable form, for example a winch or ratchet-type mechanism, or any mechanism that may be selectively controlled to selectively control the resistance provided by the arrestor (20), for example by controlling a tension of the net (30) and/or the attachment elements (34).

Although not shown in FIG. 3, area or areas of the arrestor (20), or in particular the net (30), that are likely to come into contact with the boat (for example, a bow or similar) may be reinforced. The reinforcement may involve the use of a greater thickness of net element or similar, or reinforcing the net element or elements in that region, for example using the foam and/or tubing described above.

Each individual enclosure may be provided with an individual, independent arrestor (20). In other embodiments, a single arrestor may extend across and define one or more enclosures, as for example shown in FIGS. 1 and 2.

FIG. 4 schematically depicts exemplary detail of an example embodiment of the enclosure fender (14). The Figure shows an end-on view of the enclosure fender (14). As will be understood from a review of FIG. 4 in combination with FIGS. 1 and/or 2, the enclosure fender (14) may have a substantially square or rectangular face and a relatively shallow depth. The enclosure fender (14) might thus be described as being a mattress, or mattress-like in shape or function.

Referring back to FIG. 4, the enclosure fender (14) is likely to be required to absorb an impact force, for example when a boat enters the enclosure or when the boat moves around within the enclosure. In order to achieve this functionality, the enclosure fender (14) may be energy absorbing in nature. This may be achieved by providing an enclosure fender (14) that is inflatable and deflatable, in nature. This may facilitate the required energy absorption in a convenient manner, and allow for the degree of inflation or deflation to be controlled such that the resistance or the like offered by the enclosure fender (14) is also controllable. The fenders (14) may be inflated or deflated to stable states between fully inflated and fully deflated. Such control may be useful, for example to take into account different expected impact velocities or similar, for example different boat momentums. The enclosure fender (14) may be selectively inflated and/or deflated using a valve (40).

A handle (42) might be provided, for convenient movement and positioning of the enclosure fender (14).

The enclosure fender (14) may be substantially hollow, or comprise substantially hollow cells, to allow for the inflation/deflation described above. The skin or material (44) of the fender (14) may be something that is substantially water or chemically resistant, and resistant to abrasion and/or impact. For instance, the material (44) may be or comprise polychloroprene, sometimes referred to more generally by its trade mark NEOPRENE™ Perhaps an even more abrasion resistant material might be used, for example chlorosulfonated polyethylene, sometimes referred to by its trade mark HYPALON™. Depending on the expected impact forces and degree of abrasion, it may well be that other materials might be suitable, for example any synthetic rubber.

In addition to a primary material or skin, the enclosure fender (14) might additionally comprise or be provided with cladding (46), extending fully or partially around the underlying skin or material (44). FIG. 4 shows that two bands of cladding (46) extend around the underlying skin or material (44). The location of these bands (46) may be chosen to coincide with an expected area of high abrasion or impact forces or similar, for example a rim or protrusion of a boat that is to come into contact with the enclosure fender (14). The cladding (46) may be or comprise polychloroprene, sometimes referred to more generally by its trade mark NEOPRENE™. Perhaps an even more abrasion resistant material might be used, for example chlorosulfonated polyethylene, sometimes referred to by its trade mark HYPALON™. Depending on the expected impact forces and degree of abrasion, it may well be that other materials might be suitable, for example any synthetic rubber.

FIG. 5 shows that the enclosure fender (14) may be attached to a neighbouring wall and floor (8) using appropriate fixings (50), for example one or more elephant feet, bolts and eyes, hooks and eyes, carabiners, or similar. The exact nature of the fixings may depend on whether the fixing is to be permanent, temporary, or selective insofar as that the enclosure fender (14) may be easily and readily installed and uninstalled relative to the wall and floor (8).

FIG. 6 shows that an enclosure fender (14) may be located with respect to a floor (8), and that there may not necessarily be an adjacent wall. For instance, this may apply to enclosure fenders (14) that separate one enclosure from another, such as the centrally located fenders of FIGS. 1 and 2. Referring back to FIG. 6, keeping the enclosure fender (14) upright may require one or more fixings (50) as already described. These fixings may be used in combination with one or more fixing elements or aids (52), such as straps, ropes, or the like, that interconnect with those fixings (50), for example to provide an A-frame-like structure or a cruciform-like structure. This, in combination with any natural buoyancy of the enclosure fender (14), may keep, or assist in keeping, the enclosure fender (14) upright/vertical.

FIG. 7 schematically depicts exemplary detail of an example embodiment of a support fender (12). The support fender (12) is shown relative to a part of the support (10), for example a strut or frame-part thereof.

When a boat enters or leaves the enclosure, the boat may incidentally or intentionally strike the support fender (12). Additionally, the boat may, and likely will, need to be fully supported by the support (10) at some point, for example when the boat is loaded onto the support (10). To take into account this dual purpose nature of the support (10), or parts thereof, the support fender (12) might have a composite construction. That is, the support fender (12) may comprise an impact/energy absorbing inflatable fender component (44) which may be at least partially clad (46), much the same as, or identical to, the enclosure fender previously described. In addition, however, the support fender (12) may comprise an underlying load bearing fender component (60). The energy absorbing fender (44) may lie on top of, and therefore cover, the underlying load bearing fender (60), to protect the load bearing fender (60) from impact. The load bearing fender (60) may be more resilient and/or less deformable than the overlying fender (44), and for example be or comprise solid rubber or similar. The load bearing fender (60) may comprise a sheet or the like of such material, or a frame or the like of such material.

Both the energy absorbing fender (44?) and the load bearing fender (60) may, together, be mounted or stacked or similar on a relatively rigid panel or board (62). The panel or board (62) may be provided to assist in the mounting of the energy absorbing fender (44) and the load bearing fender (60) to the support (10), and/or be provided to dissipate, in use, forces imparted onto those fenders (44, 60) to the underlying support structure (10). The panel or board (62) may be formed from, for instance, a polymer based structure or material.

In the embodiments, the use of inflation or deflation of fenders, or fender components, has been described, for example to select a fending level or resistance. In other embodiments, a fixed fender providing fixed (that is, not controllable) fending properties may be provided. For instance, a spring or other biasing means-based fender may be used.

FIGS. 8 to 13 will now be used to describe use of the cradle assembly described above.

In FIG. 8, a boat (70) is shown approaching the cradle assembly (2). The boat (70) impacts against enclosure fenders, or more generally fenders (14), forming a guide (18) of the cradle assembly (2).

FIG. 11 shows that, as already discussed above, the boat (70) is now retained within the cradle assembly (2) by being substantially enclosed by the arrestor (20), enclosure fenders (14) and the underlying support (10).

Figure 1:
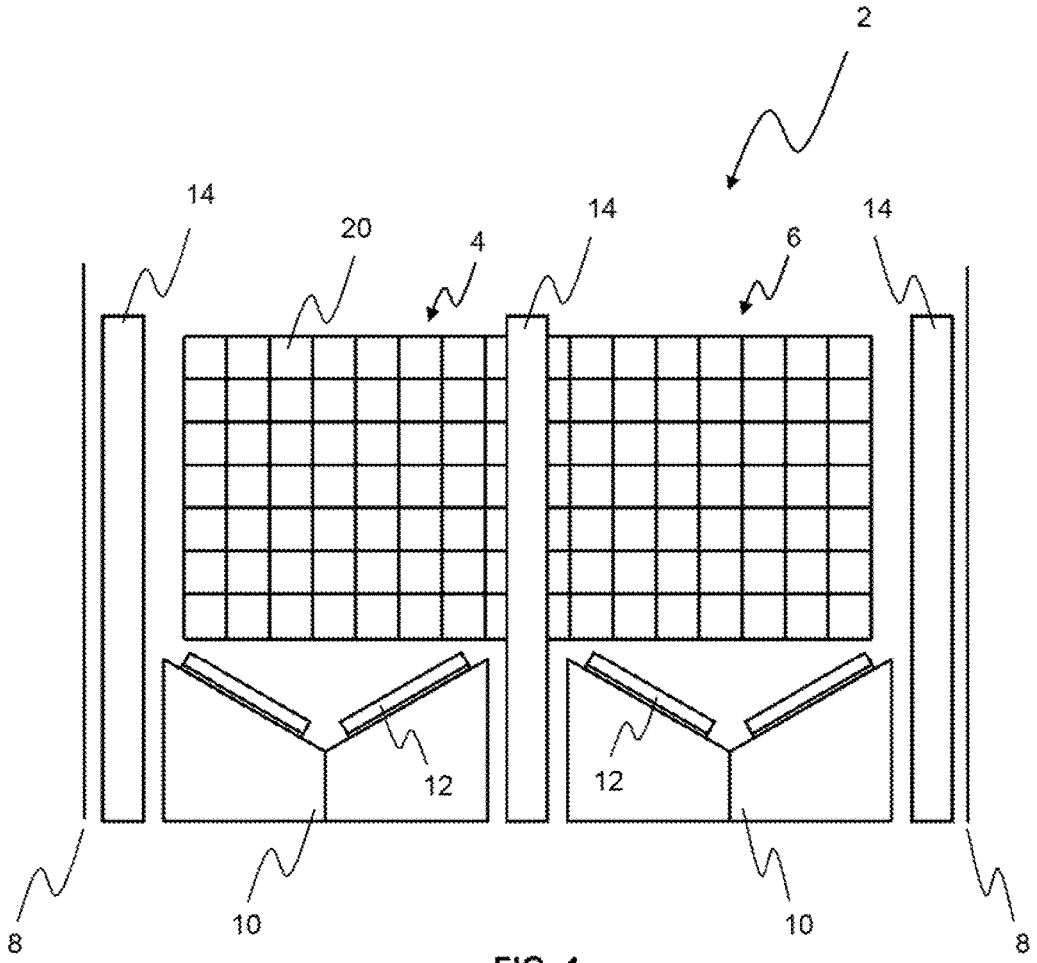
Figure 2:
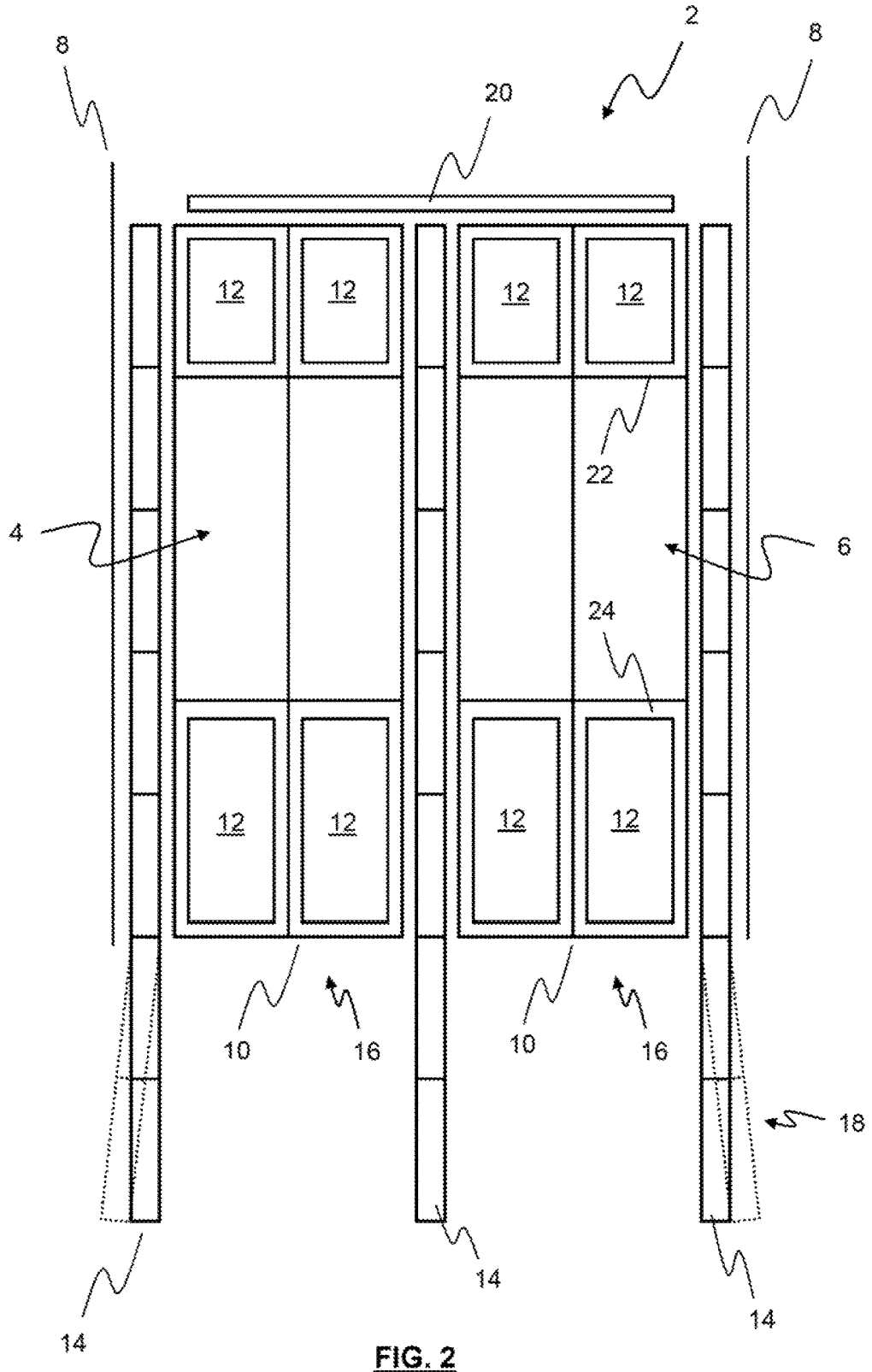
Figure 3:
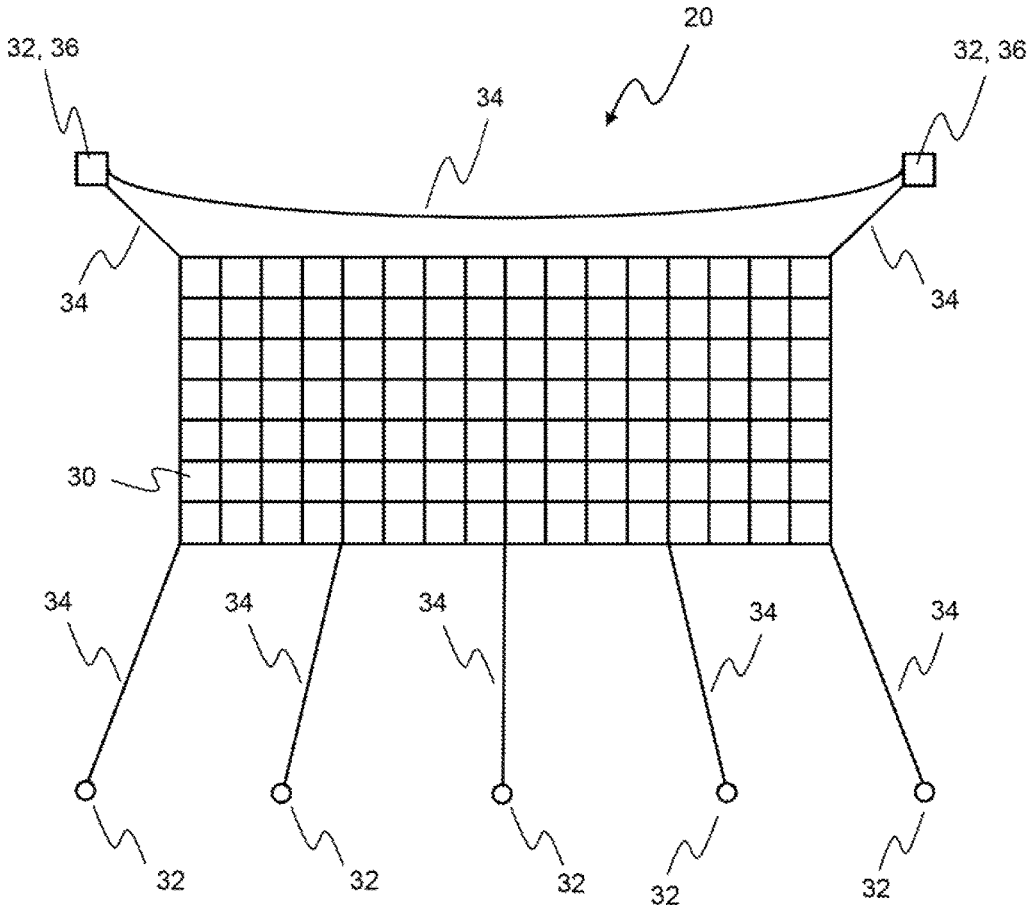
Figure 4:
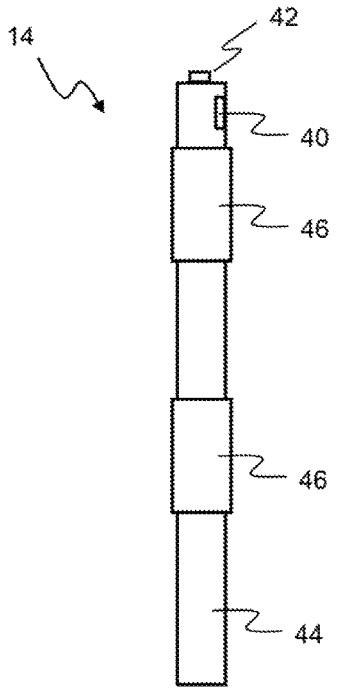
Figure 5:
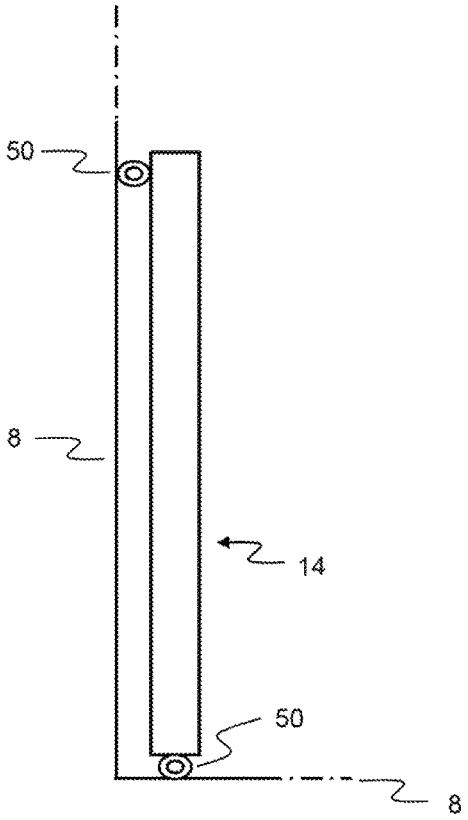
Figure 6:
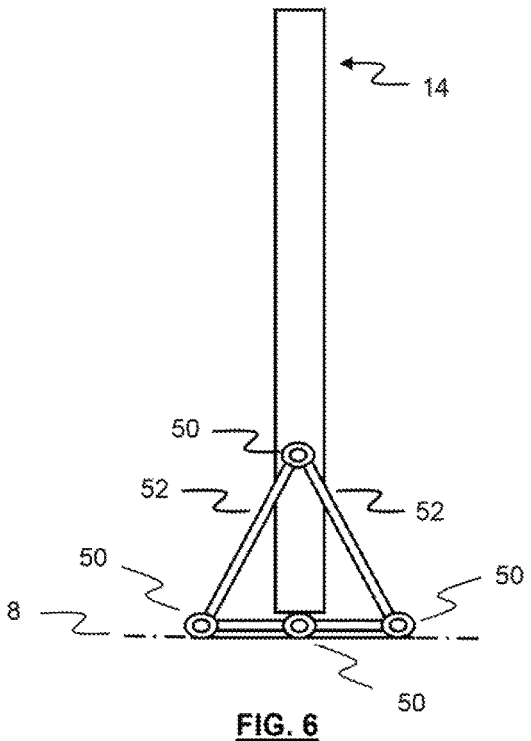
Figure 7:
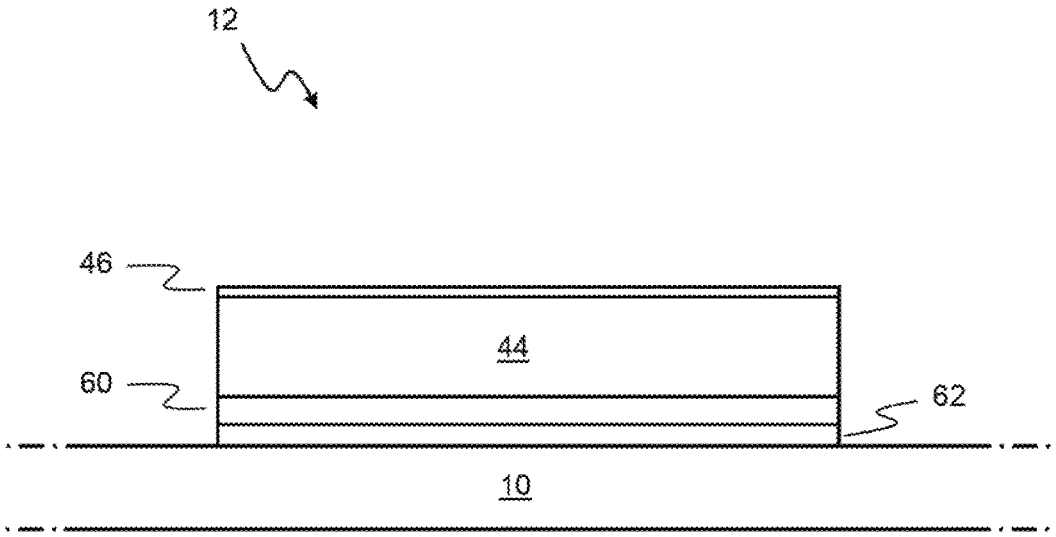
Figure 8:
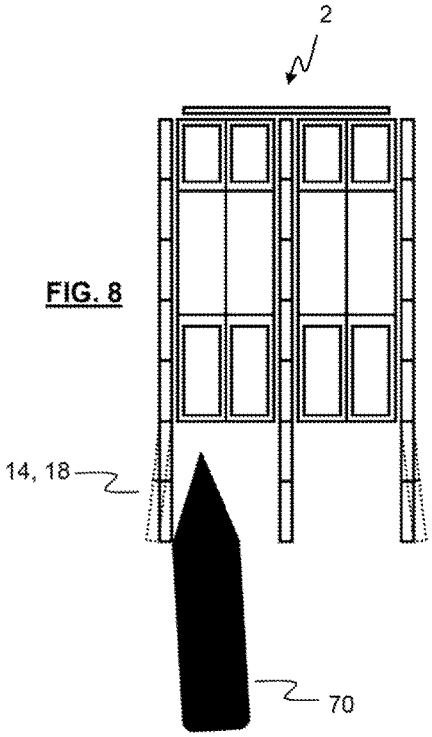
Figure 9:
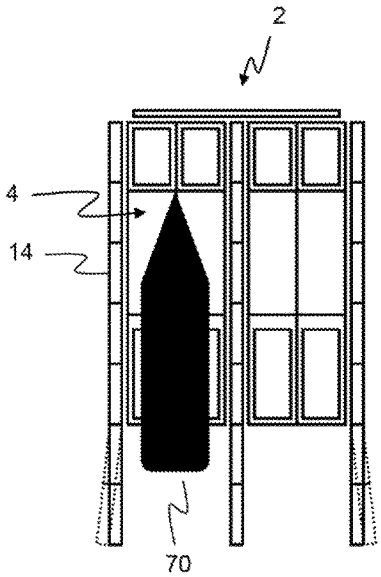
FIG. 9 shows that as a result of the guiding, the boat (70) is guided into the enclosure (4). However, the boat (70) is still moving, and needs to be arrested.
Figure 10:
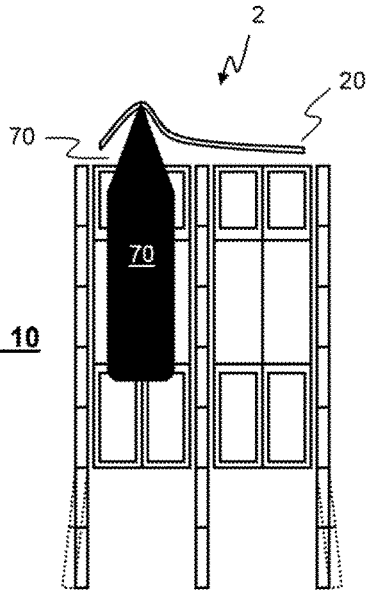
FIG. 10 shows the boat (70) impacting against the deformable arrestor (20). The arrestor (20) deforms and, as a result, arrests movement of the boat (70).
Figure 11:
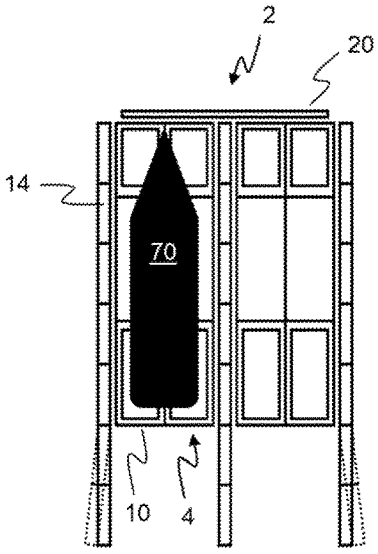
FIG. 11 shows that the arrestor (20) has returned substantially to its original form, and, as a result, has returned the boat (70) into the enclosure (4) of the cradle assembly (2).
Figure 12:
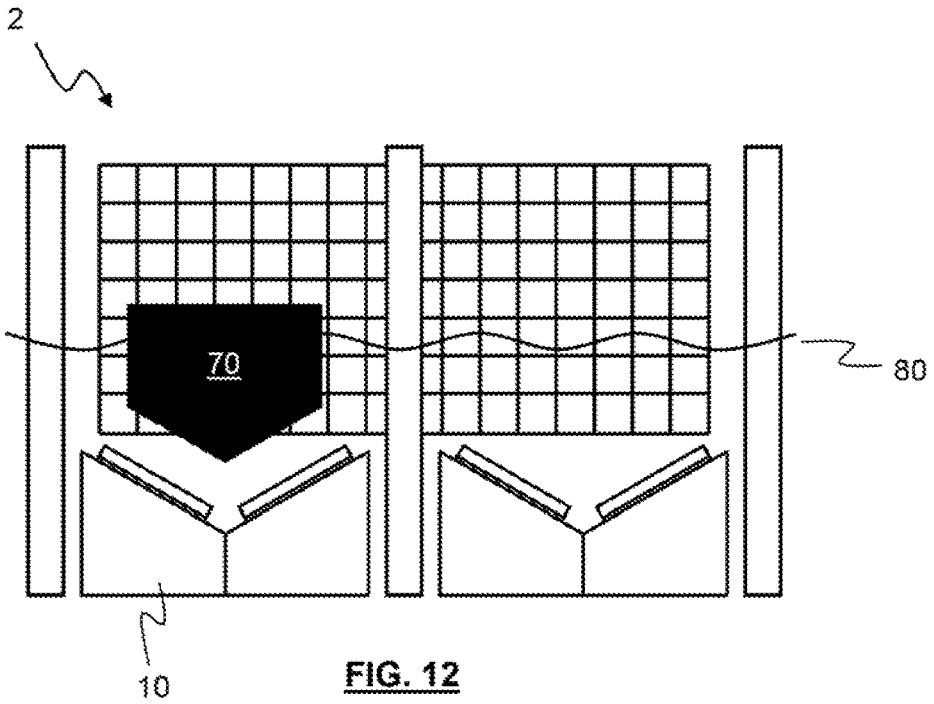

FIG. 12 shows an end-on view of the cradle assembly (2) and boat (70) of FIG. 11. FIG. 12 shows that the boat (70) floats in fluid, typically water, having a fluid level (80). Thus, even if the boat (70) did in some way impact one or more parts of the support (10) during entry into the cradle assembly (2), at this point the boat (70) is not actually sitting on and supported by the support (10).

Figure 13:
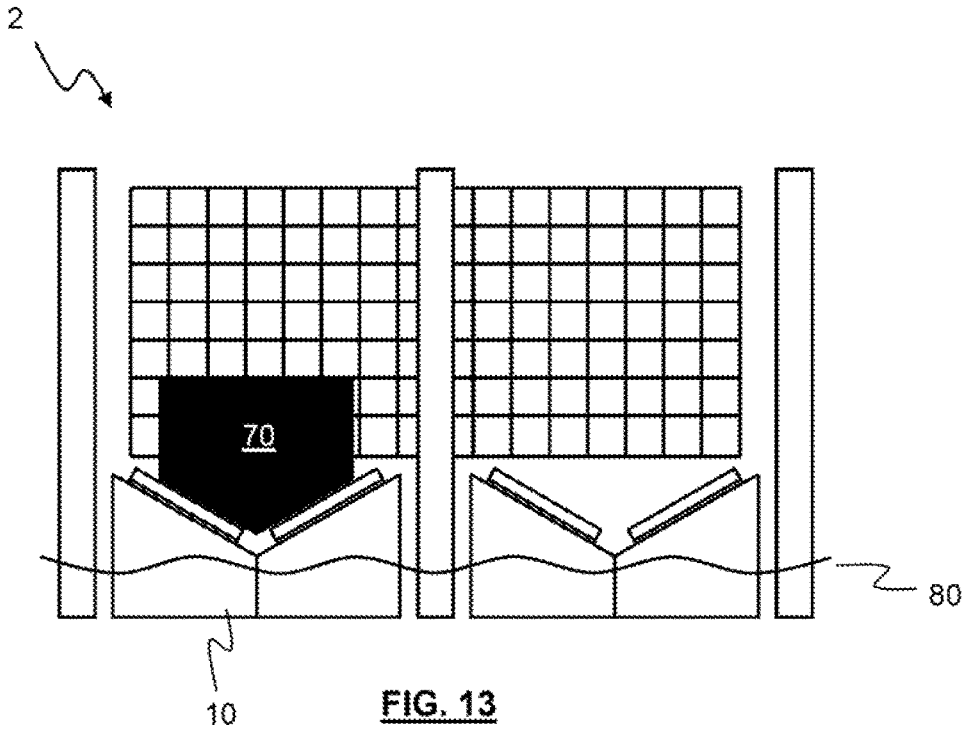

FIG. 13 shows that the fluid level (80) has decreased, allowing the boat (70) to be located onto the support (10), and thus adequately supported by the support (10). The lowering of the fluid level (80) may be achieved actively, for example by use of one or more pumps to reduce the fluid level (80), or by opening one or more outlets to reduce the fluid level (80). Alternatively, the reduction in fluid level (80) may be achieved more naturally or passively, for example by way of tidal flow or similar.

FIGS. 8 through 13 show how a boat (70) may be captured by and supported by the cradle assembly (2). Viewing the Figures in reverse from FIG. 13 through FIG. 8, it will be appreciated that the boat (70) may be launched by first raising the fluid level (80) to take the boat (70) off the support (10), thus allowing the boat (70) to move. The boat (70) may move under its own propulsion, or by external propulsion means, for example one or more launch arms or pistons or similar.

Figure 14:
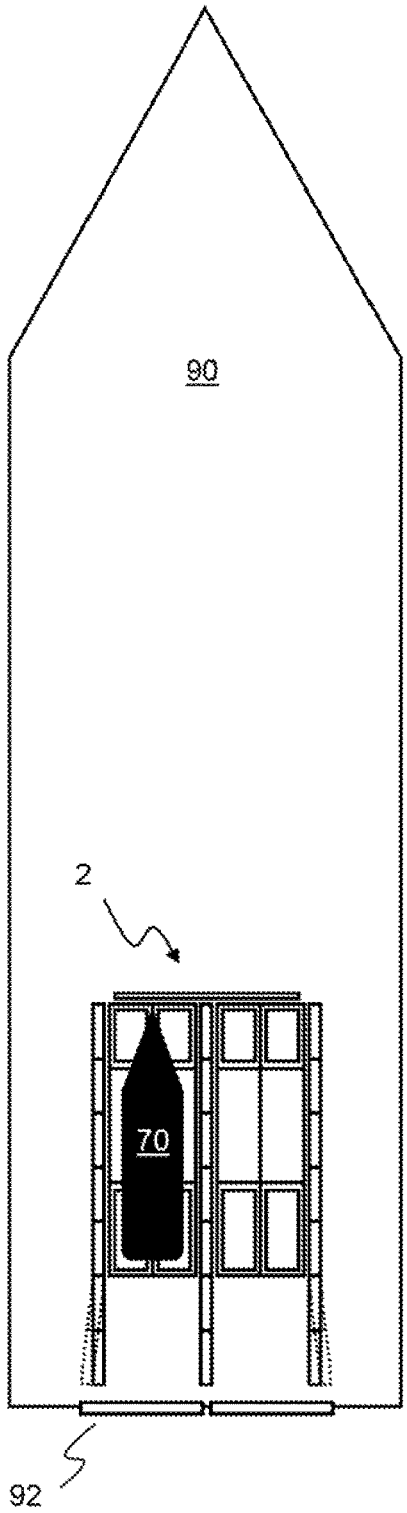

FIG. 14 shows the cradle assembly (2) forming a part of a boat (90). This allows the boat (90) to capture and cradle, or launch, a smaller boat (70). Access to the cradle assembly may be achieved via one or more doors (92) of the boat (90).

The present invention might be particularly suited for use in, or in connection with, such a larger boat (90). For instance, the advantages already described above may facilitate a smaller boat (70) entering and being captured by the larger boat (90) when the smaller boat (70) is travelling at relatively high speed. This may save time, in particular, in the capturing of the smaller boat (70), in comparison with the use of a prior art cradle assembly where the speed of the smaller boat may need to be significantly reduced to avoid significant damage to the cradle assembly or the boat itself. More generally, in accordance with an exemplary embodiment, this means that the relative speed between the larger boat (90) and the smaller boat (70) during capture may also be greater than in the prior art, without resulting in damage to the smaller boat (70), the cradle assembly (2) and/or the larger boat (90).

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A boat comprising a cradle assembly, the boat being capable of cradling a smaller boat in the cradle assembly, the cradle assembly comprising:

a support, comprising one or more support fenders;

one or more enclosure fenders extending along opposite lengths of the support;

an arrestor located at one end of the support, the arrestor including an adjuster for adjusting a resistance provided by the arrestor; and an open-ended enclosure for the smaller boat being formed between the support, the one or more enclosure fenders and the arrestor, the one or more support fenders facing into the enclosure, and the open end of the open-ended enclosure being opposite the arrestor, wherein the one or more enclosure fenders comprise an energy absorbing component configured to absorb impact when the smaller boat enters the enclosure, and wherein the cradle assembly is configured to be located in a section of the boat, within which section a fluid level is controllable to at least one of lower the smaller boat on to the support of the cradle assembly and raise the smaller boat from the support.

2. The boat of claim 1, wherein at least a part of one or more of the following is deformable or resiliently deformable:

the one or more support fenders;

the one or more enclosure fenders; and the arrestor.

3. The boat of claim 1, wherein at least one of the support fenders and the enclosure fenders are at least one of controllably inflatable and controllably deflatable.

4. The boat of claim 1, wherein at least one of the support fenders and the enclosure fenders comprise cladding.

5. The boat of claim 1, wherein at least one of the support fenders, the enclosure fenders, and any cladding thereof, comprise one or more of polychloroprene and chlorosulfonated polyethylene.

6. The boat of claim 1, wherein the support fenders comprise one or more of a predominantly energy absorbing support fender and a predominantly load bearing support fender.

7. The boat of claim 1, wherein the support fenders comprise a predominantly energy absorbing support fender and a predominantly load bearing support fender, the energy absorbing support fender covering the load bearing support fender.

8. The boat of claim 1, wherein the arrestor comprises at least one of a net and one or more kinetic energy recovery elements.

9. The boat of claim 1, wherein the support comprises first and second support sections, spaced apart from one another along a length of the support, and arranged to support fore and aft sections of the smaller boat.

10. The boat of claim 9, wherein at least one of a position and orientation of one or more parts of the support is adjustable.

11. The boat of claim 1, wherein one or more of the enclosure fenders are configured to remain in contact with the smaller boat when the smaller boat is located in the enclosure.

12. The boat of claim 1, wherein one or more enclosure fenders are provided to form a guide to the open end of the enclosure.

13. A cradle assembly for cradling a first boat, the cradle assembly comprising:

a support, comprising one or more boat support fenders, wherein the support comprises first and second support sections, spaced apart from one another along a length of the support, and arranged to support fore and aft sections of the first boat;

one or more enclosure fenders extending along opposite lengths of the support;

an arrestor located at one end of the support, wherein the arrestor comprises an adjuster for adjusting a resistance provided by the arrestor; and an open-ended enclosure for the first boat being formed between the support, the one or more enclosure fenders and the arrestor, the one or more boat support fenders facing into the enclosure, and the open end of the open-ended enclosure being opposite the arrestor;

wherein at least a part of one or more of the following is deformable or resiliently deformable:
the one or more boat support fenders;
the one or more enclosure fenders; and
the arrestor, wherein the enclosure fenders comprise an energy absorbing component configured to absorb impact when the first boat enters the enclosure, and wherein the cradle assembly is configured to be located in a section of a second boat, within which section a fluid level is controllable to at least one of
lower the first boat on to the support of the cradle assembly and
to raise the first boat from the support.

14. The cradle assembly of claim 13, wherein:

at least one of the boat support fenders and the enclosure fenders are at least one of controllably inflatable and controllably deflatable; and at least one of the boat support fenders and the enclosure fenders comprise cladding.

15. The cradle assembly of claim 13, wherein the arrestor comprises at least one of a net and one or more kinetic energy recovery elements.

16. The cradle of claim 13, wherein one or more enclosure fenders are provided to form a guide to the open end of the enclosure.

17. A boat comprising a cradle assembly, the boat being capable of cradling a smaller boat in the cradle assembly, the cradle assembly comprising:

a support, comprising one or more support fenders, the support including first and second support sections, spaced apart from one another along a length of the support, and arranged to support fore and aft sections of the smaller boat;

one or more enclosure fenders extending along opposite lengths of the support;

an arrestor located at one end of the support; and an open-ended enclosure for the smaller boat being formed between the support, the one or more enclosure fenders and the arrestor, the one or more support fenders facing into the enclosure, and the open end of the open-ended enclosure being opposite the arrestor;

wherein the one or more enclosure fenders comprise an energy absorbing component configured to absorb impact when the smaller boat enters the enclosure, and wherein the cradle assembly is configured to be located in a section of the boat, within which section a fluid level is controllable to at least one of
lower the first boat on to the support of the cradle assembly and
raise the first boat from the support.

18. The cradle assembly of claim 17, wherein the arrestor includes at least one of a net and one or more kinetic energy recovery elements, the arrestor configured to arrest motion of the smaller boat when the smaller boat enters into or onto the cradle assembly.

* * * * *